US008688015B2

(12) United States Patent
Fujita et al.

(10) Patent No.: US 8,688,015 B2
(45) Date of Patent: Apr. 1, 2014

(54) DEVELOPMENT DEVICE, PROCESSING UNIT AND IMAGE FORMING APPARATUS

(75) Inventors: Tetsumaru Fujita, Nishinomiya (JP); Kohta Sakaya, Ikeda (JP)

(73) Assignee: Ricoh Company, Ltd., Tokyo (JP)

( * ) Notice: Subject to any disclaimer, the term of this patent is extended or adjusted under 35 U.S.C. 154(b) by 273 days.

(21) Appl. No.: 13/196,413

(22) Filed: Aug. 2, 2011

(65) Prior Publication Data

US 2012/0033997 A1 Feb. 9, 2012

(30) Foreign Application Priority Data

Aug. 3, 2010 (JP) ..... 2010-174509

(51) Int. Cl.
*G03G 15/08* (2006.01)

(52) U.S. Cl.
USPC ..... 399/260; 399/255

(58) Field of Classification Search
USPC ..... 399/255, 260, 263
See application file for complete search history.

(56) References Cited

U.S. PATENT DOCUMENTS

| | | | | |
|---|---|---|---|---|
| 4,173,405 | A * | 11/1979 | Swapceinski et al. | 399/256 |
| 5,264,900 | A * | 11/1993 | Momiyama et al. | 399/256 |
| 5,345,298 | A * | 9/1994 | Corrigan, Jr. | 399/260 |
| 6,088,561 | A * | 7/2000 | Kawamura et al. | 399/262 |
| 6,850,722 | B2 * | 2/2005 | Sakemi et al. | 399/223 |
| 7,292,817 | B2 * | 11/2007 | Murakami et al. | 399/358 |
| 7,676,184 | B2 | 3/2010 | Murayama et al. | |
| 7,761,038 | B2 * | 7/2010 | Moon et al. | 399/260 |
| 7,831,182 | B2 | 11/2010 | Konishi et al. | |
| 2003/0072590 | A1 * | 4/2003 | Shimaoka et al. | 399/258 |
| 2008/0292363 | A1 * | 11/2008 | Moon et al. | 399/258 |
| 2009/0067887 | A1 | 3/2009 | Fujita et al. | |

FOREIGN PATENT DOCUMENTS

| | | | | |
|---|---|---|---|---|
| JP | 06208295 | A * | 7/1994 | G03G 15/08 |
| JP | 9-269642 | | 10/1997 | |
| JP | 2008-275725 | | 11/2008 | |

OTHER PUBLICATIONS

U.S. Appl. No. 13/025,266, filed Feb. 11, 2011, Atsushi Takehara, et al.
U.S. Appl. No. 13/013,224, filed Jan. 25, 2011, Kohta Sakaya, et al.

* cited by examiner

*Primary Examiner* — Clayton E Laballe
*Assistant Examiner* — Leon W. Rhodes, Jr.
(74) *Attorney, Agent, or Firm* — Oblon, Spivak, McClelland, Maier & Neustadt, L.L.P.

(57) ABSTRACT

A development device includes a developer carrier configured to carry on a surface thereof a developer, the developer carrier being disposed to face a latent image carrier, a developer tank having the developer carrier, a developer container configured to house the developer to be supplied to the developer tank, the developer container being connected to the developer tank through a partition having an opening, and a developer carrier member configured to carry the developer in the developer container, the developer being supplied to the developer tank from the opening while being carried by the developer carrier member, and the amount of developer to be supplied to the developer tank from the opening being gradually increased in a developer carrying direction of the developer carrier member.

20 Claims, 4 Drawing Sheets

DEVELOPMENT DEVICE, PROCESSING UNIT AND IMAGE FORMING APPARATUS

PRIORITY CLAIM

The present application is based on and claims priority from Japanese Patent Application No. 2010-174509, filed on Aug. 3, 2010, the disclosure of which is hereby incorporated by reference in its entirety.

BACKGROUND

1. Technical Field

The present invention relates to a development device for use in an image forming apparatus such as a copier, a printer, a facsimile or a machine combining these, a processing unit and an image forming apparatus using the development device.

2. Description of the Related Arts

In an image forming apparatus such as a copier, a printer, a facsimile, or a machine combining these, an electrostatic latent image is formed on a latent image carrier, and a dry development device using powder developer for visualizing such an electrostatic latent image is widely adopted. As the developer, a two-component system developer having toners and carriers, a one-component system developer without having carriers, or the like is used.

This kind of development device generally includes a developer tank which is substantially sealed except for a portion facing a latent image carrier as a photoreceptor. The developer tank includes in the inside thereof, for example, a development roller which supplies toners to a photoreceptor, a supply roller which supplies toners to the development roller, and a control blade which controls the amount of toner supplied to the development roller. The development device also includes a toner container in which unused toners supplied from a toner supply bottle are retained. This toner container includes in the inside thereof an agitator which agitates and carries the toners. If the toners in the developer tank are used to form an image, the toners are supplied to the developer tank from the toner container by the agitator (for example, refer to Japanese Patent Application Publication No. 2008-275725).

The toners in the developer tank are stressed by passing through the contact portion of the development roller and the supply roller, the contact portion of the development roller and the control blade and the contact portion of the development roller and the photoreceptor in an image forming operation, so that an external additive added to improve the fluidity of the toners may be buried in the toners or may be separated, or the toners may be damaged or may be deformed, resulting in the decrease in the toner charge potential. If new toners in the toner container are supplied to the old toners in which the charge potential is decreased in the developer tank, the charge is interchanged between the old toners and the new toners by mixing the toners having different charge potential. As a result, the new toners are more highly charged higher than in general. In contrast, if the old toners are charged to a lower degree than in general, or charged in a reverse polarity, so-called surface staining, in which the toners adhere onto the background part (non-image part) of the photoreceptor, may occur, or variations in image concentration may occur.

In particular, if a lot of new toners are supplied to the developer tank from the toner container at one time, mutual charging between the toners rapidly occurs, so that the above-described surface staining and variations in image concentration tend to occur to a significant degree.

SUMMARY

The present invention has been made in view of the above circumstances, and aims to provide a development device which can stably obtain a preferable image quality by controlling rapid mutual charging between new toners and old toners, a processing unit and an image forming apparatus having the development device.

One embodiment of the present invention provides a development device, including: a developer carrier configured to carry on a surface thereof a developer, the developer carrier being disposed to face a latent image carrier; a developer tank having the developer carrier; a developer container configured to house the developer to be supplied to the developer tank, the developer container being connected to the developer tank through a partition having an opening; and a developer carrier member configured to carry the developer in the developer container, the developer being supplied to the developer tank from the opening while being carried by the developer carrier member, and the amount of developer to be supplied to the developer tank from the opening being gradually increased in a developer carrying direction of the developer carrier member.

One embodiment of the present invention also provides an image forming apparatus, including: a developer carrier configured to carry on a surface thereof a developer, the developer carrier being disposed to face a latent image carrier; a developer tank having the developer carrier; a developer container configured to house the developer to be supplied to the developer tank, the developer container being connected to the developer tank through a partition having an opening; and a developer carrier member configured to carry the developer in the developer container, the developer being supplied to the developer tank from the opening while being carried by the developer carrier member, and the amount of developer to be supplied to the developer tank from the opening being gradually increased in a developer carrying direction of the developer carrier member.

BRIEF DESCRIPTION OF DRAWINGS

The accompanying drawings are included to provide further understanding of the invention, and are incorporated in and constitute a part of this specification. The drawings illustrate an embodiment of the invention and, together with the specification, serve to explain the principle of the invention.

DESCRIPTION OF PREFERRED EMBODIMENT

Hereinafter, an embodiment of the present invention will be described with reference to the drawings. In addition, the same reference numbers are applied to the same portions or corresponding portions in each figure, and the description thereof will be appropriately simplified or omitted.

Figure 1:
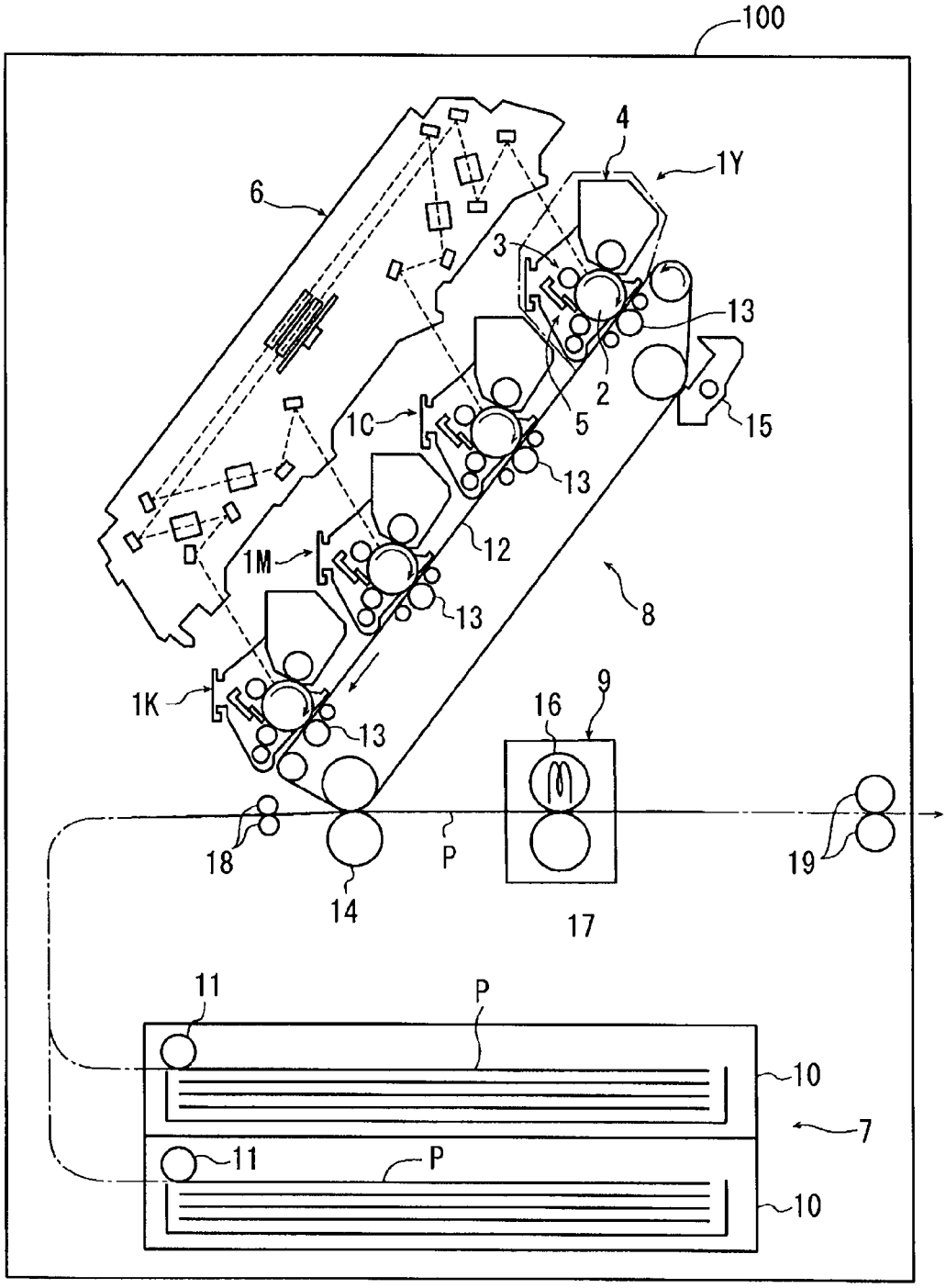
FIG. 1 is a schematic view illustrating a color image forming apparatus according to an embodiment of the present invention.

FIG. 1 is a schematic view illustrating a color image forming apparatus according to an embodiment of the present invention.

The image forming device illustrated in FIG. 1 includes a tandem image forming section in which four processing units 1Y, 1C, 1M, 1K as image forming units are arranged. Each processing unit 1Y, 1C, 1M, 1K is removable from an image forming apparatus body 100. The processing units have the same configuration except that the processing units house toners of different colors, yellow (Y), cyan (C), magenta (M) and black (K) corresponding to a color separation component of a color image, respectively. Specifically, each processing unit 1Y, 1C, 1M, 1K has a drum like photoreceptor 2 as a latent image carrier, a charger 3 which charges the surface of the photoreceptor 2, a development device 4 which forms a toner image on the photoreceptor 2, and a cleaner 5 which eliminates toners on the surface of the photoreceptor 2. In FIG. 1, reference numbers are applied only to the charger 3, the development device 4 and the cleaner 5 of the yellow processing unit 1Y, and reference numbers in the other processing units 1C, 1M, 1K are omitted.

The image forming apparatus also includes an exposure device 6 which exposes the surface of the photoreceptor 2 of each processing unit 1Y, 1C, 1M, 1K, a paper feeder 7 which supplies paper P as a sheet-like recording medium, a transfer device 8 which transfers an image on the paper P, and a fuser 9 which fuses an image transferred onto the paper P.

The exposure device 6 includes a light source, a polygon mirror, an f-θ lens, and a reflection mirror, and irradiates laser light onto the surface of each photoreceptor 2 based on image data. The paper feeder 7 includes a paper feeding cassette 10 which houses the paper P and a paper feeding roller 11 which feeds the paper P from the paper feeding cassette 10.

The transfer device 8 includes an intermediate transfer belt 12 having an endless belt as a transfer body. The intermediate transfer belt 12 is stretched by a plurality of supporting rollers. The intermediate transfer belt 12 rotates (runs) in the direction illustrated by the arrow in the figure by rotating one of the supporting rollers as a driving roller. Four primary transfer rollers 13 as primary transfer devices are disposed in positions facing the photoreceptors 2 via the intermediate transfer belt 12, respectively. The primary transfer rollers 13 are connected to a not shown power source, and a predetermined direct voltage (DC) and/or alternating voltage (AC) are/is applied to the primary transfer rollers 13. It is preferable for the primary transfer roller 13 to have a semi-conductive property containing an inorganic electrical conductive material such as carbon black and an ion electrical conductive material for adjusting an electric resistance. This is because the transfer efficiency stays about the same if the resistance value of the primary transfer roller 13 is different, but if an image area ratio is small, the transfer voltage value is reduced, so that an electric field required for transferring can not be sufficiently obtained. In particular, if the resistance value of the primary transfer roller 13 is low, the influence of the resistance value of the toners in the transfer portion is increased, so that if the resistance value of the primary transfer roller 13 is low, the situation which can not sufficiently obtain the electric field required for transferring becomes remarkable. Accordingly, when constant current control is adopted as described above, it is preferable to use a primary transfer roller having a high resistance value as the primary transfer roller 13.

A secondary transfer roller 14 as a secondary transfer device has contact with the outer circumferential face of the intermediate transfer belt 12. The secondary transfer roller 14 is connected to a not shown power source, and predetermined direct voltage (DC) and/or alternating voltage (AC) are/is applied to the secondary transfer roller 14, similar to the primary transfer roller 13.

The intermediate transfer belt 12 includes a cleaner 15 which cleans the surface of the intermediate transfer belt 12. The cleaner 15 cleans toners remaining on the intermediate transfer belt 12 and additive of paper adhered as stains.

This image forming apparatus includes a not shown lubricant agent coating applicator for applying lubricant agent to the intermediate transfer belt 12. As the lubricant agent coating applicator, for example, a lubricant agent coating applicator, which scrapes solid lubricant agent by a rotation brush roller to be applied on the surface of the intermediate transfer belt 12, is applicable. In addition, a lubricant agent coating applicator having a similar function can be disposed relative to the photoreceptor 2. As the solid lubricant agent, a dry solid hydrophobic lubricant agent can be used, and metallic compound having a fatty acid group such as stearic acid, oleic acid, or palmitic acid can be also used in addition to zinc stearate. Moreover, wax such as candelilla wax, carnauba wax, rice wax, Japan wax, ohba oil, beeswax or lanolin can be used.

The fuser 9 includes a fusing roller 16 having in the inside thereof a halogen heater and a pressure roller 17 disposed to face the fusing roller 16 while having contact with the fusing roller 16. The fuser 9 is controlled by a not shown controller to be the most suitable fusing condition according to a full-color image or a monochrome image, one surface or both surfaces or the type of paper.

As illustrated in FIG. 1, a pair of resist rollers 18 which adjusts the feeding timing of the paper P is disposed on the upstream side of the paper feeding direction of the secondary transfer roller 14. A pair of paper discharge rollers 19 which discharges the paper P outside the apparatus is disposed on the downstream side of the paper feeding direction of the fuser 9.

Hereinafter, the basic operation of the image forming apparatus will be described with reference to FIG. 1.

Upon the start of an image forming operation, the photoreceptor 2 of each processing unit 1Y, 1C, 1M, 1K rotates in the clockwise direction in the figure by a not shown driver, and the surface of each photoreceptor 2 is uniformly charged to a predetermined polarity by the charger 3. An electrostatic latent image is formed on the surface of each charged photoreceptor 2 by irradiating laser light from the exposure device 6. In this case, the image information exposed on each photoreceptor 2 is single image information in which a predetermined full color image read by a not shown image reader is decomposed into color information of yellow, cyan, magenta and black. By supplying toners to the electrostatic latent image formed on the photoreceptor 2 by each development device 4, the electrostatic latent image is visualized as a toner image.

If the driving roller on which the intermediate transfer belt 12 is stretched rotates, the intermediate transfer belt 12 rotates (runs) in the direction illustrated by the arrow in the figure. The voltage in which the constant voltage or the constant current having a polarity opposite to the charging polarity of the toners is controlled is applied to each primary transfer roller 13. A transfer electric field is thereby formed in a primary transfer nip between each primary transfer roller 13 and each photoreceptor 2. The toner image of each color formed on each photoreceptor 2 is sequentially transferred onto the intermediate transfer belt 12 by the transfer electric field formed in the primary transfer nip. Accordingly, the intermediate transfer belt 12 carries on the surface thereof a full-color toner image. After transferring the toner image, the toners remaining on the surface of each photoreceptor 2 are eliminated by the cleaner 5.

Moreover, upon the start of an image forming operation, the rotation of the paper feeding roller 11 is started, and then the paper P housed in the paper feeding cassette 10 is fed. The fed paper P is once stopped by the resist rollers 18. After that, the driving of the resist rollers 18 is restarted, and the paper P is fed to the secondary transfer nip between the secondary transfer roller 14 and the intermediate transfer belt 12 in accordance with the toner image on the intermediate transfer belt 12. The transfer voltage having a polarity opposite to the toner charging polarity of the toner image on the intermediate transfer belt 12 is applied to the secondary transfer roller 14, and the transfer electric field is thereby formed in the secondary transfer nip. When the paper P and the toner image on the intermediate transfer belt 12 reach the secondary transfer nip, the toner image on the intermediate transfer belt 12 is transferred onto the paper P by the transfer electric field formed in the secondary transfer nip at once. The toners remaining on the intermediate transfer belt 12 after transferring are eliminated by the cleaner 15, and the eliminated toners are retained in a not shown container.

The paper P on which the toner image is transferred is fed to the fuser 9. Then, the paper P is heated and pressed by the fusing roller 16 and the pressure roller 17, and the toner image is fused on the paper P. After that, the paper P is discharged outside the apparatus by the paper discharge rollers 19, and stacked on a not shown paper discharge tray.

The above description relates to the operation when forming a full-color image on recording paper. A single color image can be formed by using any one of the four processing units 1Y, 1C, 1M, 1K or a two-color or three-color image can be formed by using two or three processing units.

Figure 2:
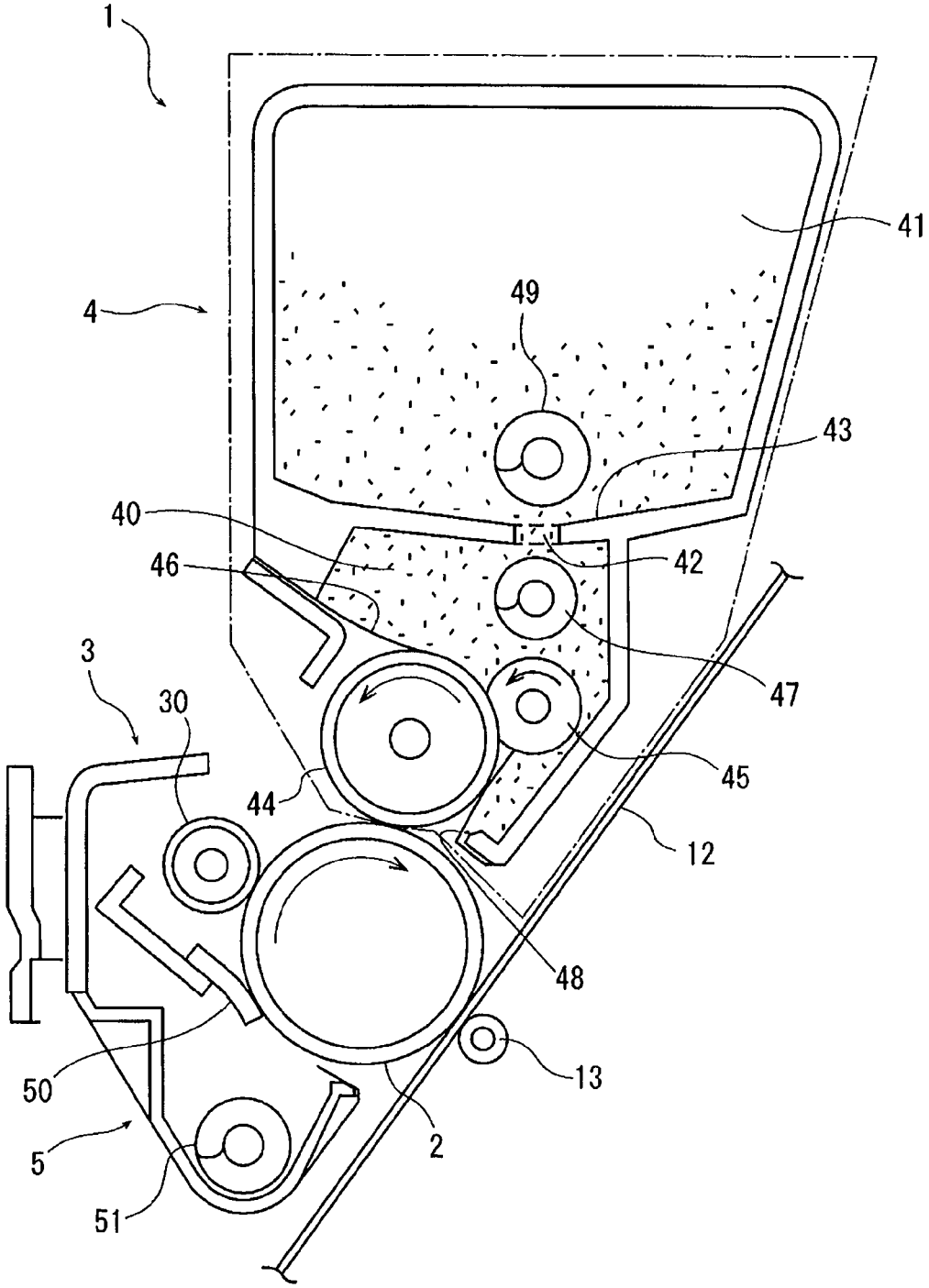
FIG. 2 is a schematic view illustrating a processing unit according to an embodiment of the present invention.

FIG. 2 is a schematic view illustrating the above processing unit for use in the image forming apparatus. Since the four processing units have the same configuration, the characters, Y, C, M, K indicating colors are omitted in FIG. 2.

The photoreceptor 2 is constituted of amorphous silicon, metal such as selenium, or an organic photoreceptor. In this case, an example in which the photoreceptor 2 is an organic photoreceptor will be described. The organic photoreceptor includes on a conductive supporting body a resin layer of filler dispersion, a photosensitive layer having a charge generation layer and a charge transport layer and a protective layer of filler dispersion. The photosensitive layer can be a photosensitive layer having a single layer containing a charge generation substance and a charge transport substance, but a laminated type constituted of the charge generation layer and the charge transport layer is superior to sensitivity and resistance. The charge generation layer is formed by dispersing pigment having a charge generation characteristic in an appropriate solvent with binder resin by using a ball mill, an attritor, a sand mill or ultrasonic wave, applying this on the conductive supporting body and drying the conductive supporting body.

The charge transport layer can be formed by dissolving or dispersing a charge transport substance and binder resin in an appropriate solvent, applying this on the charge generation layer, and drying the layer. The charge transport substance includes a hole transport substance and an electron transport substance. The binder resin includes a thermosetting resin or a thermoplastic resin such as polystyrene, styrene-acrylonitrile copolymer, styrene-butadiene copolymer, styrene-anhydrous maleic acid copolymer, polyester, polyvinyl chloride, vinylchloride-vinyl acetate copolymer, polyvinyl acetate, polyvinylidene chloride, polyarate, phenoxy resin, polycarbonate, cellulose acetate resin, ethylcellulose resin, polyvinyl butyral, polyvinyl formal, polyvinyl toluene, poly-N-vinyl carbazole, acrylate resin, silicone resin, epoxy resin, melamine resin, urethane resin, phenol resin and alkyd resin.

The protective layer may be provided on the photosensitive layer. By providing the protective layer, the durability can be improved, so that the high-sensitive photoreceptor 2 without having a defect can be effectively used. A material for use in the protective layer includes a resin such as ABS resin, ACS resin, olefin-vinyl monomer copolymer, chlorinated polyether, allyl resin, phenol resin, polyacetal, polyamide, polyamide imide, polyacrylate, polyallylic sulfone, polybutylene, polybutylene terephthalate, polycarbonate, polyarylate, polyether sulfone, polyethylene, polyethylene terephthalate, polyimide, acrylate resin, polymethypentene, polypropylene, polyvinyliden chloride, and epoxy resin. Among these, polycarbonate or polyarylate can be most preferably used. Moreover, in order to improve abrasion resistance, fluoropolymer such as polytetrafluoroethylene, silicone resin, or a resin in which inorganic filler such as titanic oxide, tin oxide, potassium titanate or silica or organic filler is dispersed in these resin can be added to the protective layer. The filler concentration in the protective layer differs according to a type of filler or an electrophotographic process condition using the photoreceptor 2, but it is preferable for a ratio of filler relative to the total dissolved solid on the surface layer side of the protective layer to be about 5 mass % or more, preferably about 10 mass % or more and about 50 mass % or below, preferably about 30 mass % or below.

The charger 3 includes a charging roller 30 as a charging member in which an elastic layer having a middle resistance is covered on the outside of the conductive core. The charging roller 30 is connected to a not shown power source, and predetermined direct voltage (DC) and/or alternating voltage (AC) are/is applied to the charging roller 30. The charging roller 30 which discharges this ion uses an elastic resin roller as a material. In order to adjust the electric resistance of the charging roller 30, the charging roller 30 may contain an ion electric conductive material or an inorganic electric conductive material such as carbon black.

The charging roller 30 is disposed to have a minute distance to the photoreceptor 2. This minute distance can be set by providing spacer members having a certain thickness on the non-image forming areas of both end portions of the charging roller 30, respectively, and brining the surfaces of the space members into contact with the surface of the photoreceptor 2, for example. The charging roller 30 can be brought into contact with the photoreceptor 2 without providing the minute distance to the photoreceptor 2. The charging roller 30 charges the photoreceptor 2 by discharging in a portion close to the photoreceptor 2. Moreover, since the charging roller 30 does not have contact with the photoreceptor 2, the generation of stains due to the remaining toners of the charging roller 30 can be controlled. The charging roller 30 includes a not shown charging cleaner roller which cleans the surface of the charging roller 30 in contact with the surface of the charging roller 30.

The cleaner 5 includes a cleaning blade 50 and a waste toner collection coil 51. The cleaning blade 50 has contact with the photoreceptor 2 by a counter method, so that the toners remaining on the photoreceptor 2 and the additive such as calcium carbonate, kaolin or talc of a recording member adhered as stain are removed from the photoreceptor 2. The removed toners and the like are transported to a not shown waste toner container by the waste toner collection coil 51 to be retained. By controlling a not shown mechanism with a controller of the image forming apparatus body, the cleaning blade 50 can have arbitrary contact with the photoreceptor 2 and can arbitrary separate from the photoreceptor 2.

The development device 4 includes a developer tank 40 and a developer container 41 disposed above the developer tank 40. The developer tank 40 and the developer container 41 are connected to each other via a partition 43 having an opening 42.

The developer tank 40 includes in the inside thereof a development roller 44 as a developer carrier which is disposed to face the photoreceptor 2 and carries on the surface thereof a developer, a supply roller 45 as a developer supplying member which supplies developer to the development roller 44, a control blade 46 as a control member which controls the amount of developer on the development roller 44, an agitation screw 47 as a developer agitator which agitates the developer in the developer tank 40, and a sealing member 48 which is disposed near the development roller 44 and prevents the leakage of the developer from the developer tank 40.

The developer container 41 includes in the inside thereof a carrier screw 49 as a developer carrier member which carries the developer in the developer container 41. The carrier screw 49 is rotatably disposed near the opening 42 of the partition 43, and rotates when the developer concentration is lowered by the signals from a not shown sensor which detects the developer concentration in the development tank 40, so that the developer is supplied to the developer tank 40 from the developer container 41.

The development roller 44 is made of conductive urethane about 12 mm in diameter on a cored bar about 6 mm in diameter, and uses a high-resistance elastic body $5\times10^6$ Ω· cm or more in volume resistance. The supply roller 45 is made of a roller about 10 mm in diameter formed by a urethane foam material conducted by carbon. The control blade 46 is made of stainless steel 0.1 mm in thickness, and controls the toner layer by bending the leading end into an L-shape. The control blade 46 has contact with the development roller 44 with pressure, and is applied at about −100V to the development roller 44. The seal member 48 is made of conductive PTFE $1\times10^0$ Ω· cm-$1\times10^5$ Ω· cm in volume resistance. The seal member 48 has an electric potential which is the same as that of the development roller 44, and removes the electricity of the developer on the development roller 44 and returns the developer to the developer tank 40.

The speed of the development roller 44 is about 20 rpm, but the linear speed of the photoreceptor is about 120 mm/s. The development roller 44 rotates in the direction which is the same as the photoreceptor 2 with the linear speed ratio of 1.4. The supply roller 45 reversely rotates to the development roller 44, and rotates with the linear speed ratio of 1.0.

In FIG. 2, if the development roller 44 and the supply roller 45 rotate in the counterclockwise direction, the developer adhered onto the surface of the supply roller 45 is supplied on the surface of the development roller 44, and the developer on the development roller 44 is controlled to a predetermined amount by the control blade 46 in a position where the development roller 44 faces the control blade 46. If the developer on the development roller 44 is transported to the position facing the photoreceptor 2, the developer is electrically supplied on the electrostatic latent image on the photoreceptor 2. After that, the developer on the development roller 44 which is not supplied to the photoreceptor 2 returns to the developer tank 40 again after removing the electricity by the seal member 48.

In the development device 4 according to the present embodiment, one-component developer is used. However, the configuration of the present embodiment can be applied to a development device using two-component developer including toners and carriers. Magnetic toners and non-magnetic toners can be used for the one-component developer. In the image forming apparatus of the present embodiment, which forms a color image, the non-magnetic toners are preferably used. Crushed toners of 8.5 μm in volume average particle diameter by polyester resin as binder resin are used. The materials of the toners include, for example, 68 pts.wt. of polyester resin A (softening point 131° C., AV value 25), 32 pts.wt. of polyester resin B (softening point 116° C., AV value 1.9), 8 pts.wt. of masterbatch of cyan (containing 50 pts.wt. of Pigment Blue 15:3) and 8 pts.wt. of carnauba wax. After sufficiently mixing these toner materials by a Henschel mixer, these toner materials are melted and kneaded by using a machine in which a discharge portion is removed from a two-axis extruding and kneading machine (PCM-30 made by Ikegai Corp.), and the obtained mixture is extended to 2 mm in thickness by applying pressure with a cooling press roller. After cooling with a cooling belt, the mixture is roughly crushed with a feather mill. After that, the mixture is crushed by a mechanical crusher (KTM made by Kawasaki Heavy Industries, Ltd.) to 10-12 μm in an average particle diameter, and then is crushed by a jet crusher (IDS made by Nippon Penumatic Mfg. Co. Ltd) while roughly classifying. After that, the fine powder classification is performed by using a rotary classifier (classifier type 100 ATP made by Hosokawa Micron Corporation), so as to obtain the toner base of 7.9 in a volume average particle diameter and 0.910 in average circularity. Silica (RX20) of 1 pts. wt. is added to toner base of 100 pts. wt., and they are mixed for 5 minutes at 40 m/sec of rim speed by a Henschel mixer, so as to obtain toners. In the development device 4 of the present embodiment, the developer is stressed in the development device 4 without using agitation and mixture medium such as carriers, and the developer is smoothly transported such that the developer does not remain.

Figure 3:
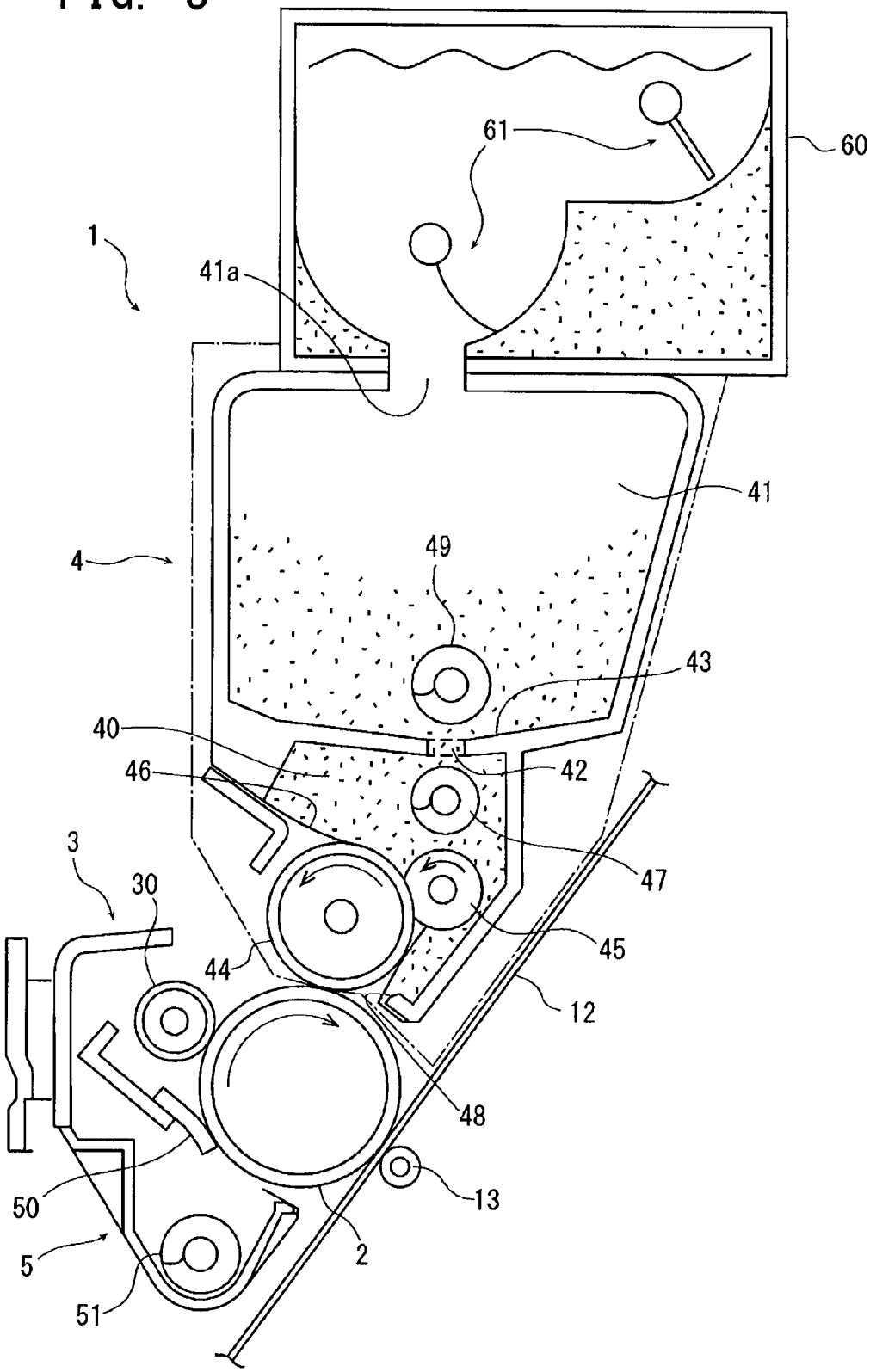
FIG. 3 is a schematic view illustrating a state in which a supply container is provided in a development device according to an embodiment of the present invention.

As illustrated in FIG. 3, a supply container 60 which houses unused toners for supply is removably provided above the development device 4. If the supply opening 41*a* provided on the upper portion of the developer container 41 opens in a state in which the supply container 60 is disposed on the development device 4, the toners can be supplied to the developer container 41 from the supply container 60. The supply container 60 includes in the inside thereof an agitator 61 which agitates the toners.

If the amount of toners in the developer tank 40 is reduced by forming an image, a predetermined amount of toners is supplied in the developer container 41 from the supply container 60. The timing of supplying toners is predetermined based on the information in which the amount of toners in the developer tank 40 or the developer container 41 is detected by a detector or the toner consumption obtained by a printing dot counter. Moreover, most of the toners in the supply container 60 can be supplied at one time.

Figure 4:
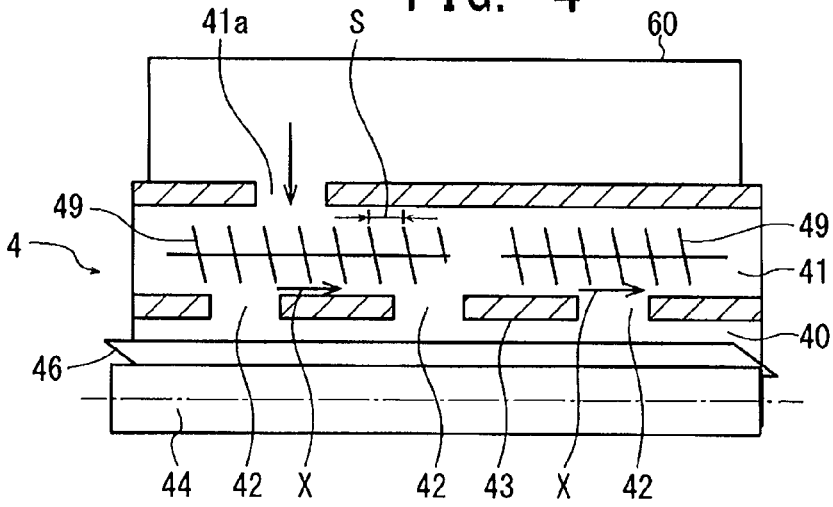
FIG. 4 is a sectional view illustrating a configuration of the development device.

FIG. 4 is a sectional view illustrating a configuration of the development device 4.

As illustrated in FIG. 4, a plurality of openings 42 of the partition 43 in the present embodiment is provided in the developer carrying direction illustrated by the arrow X in the figure. The toners supplied from the supply container 60 to the developer container 41 are carried in the axis direction (the direction of arrow X in FIG. 4) by the carrier screw 49, and fall in the developer tank 40 from the openings 42 of the partition 43 so as to be supplied. Then, the toners supplied in the developer tank 40 are agitated by the agitation screw 47 (refer to FIG. 2), and are mixed with the toners in the developer tank 40. In the present embodiment, since the supply roller 45 and the control blade 46 are provided in the developer tank 40, the agitation and mixing of the toners are effectively performed in the developer tank 40 by the flow of the toners by the supply roller 45 and the flow of the toners which have not passed through the control blade 46.

Figure 5:
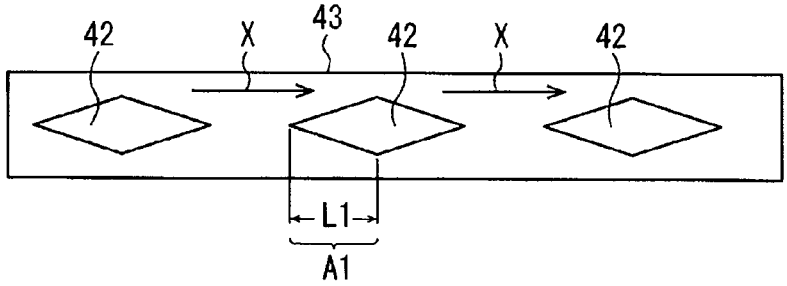
FIG. 5 is a plan view illustrating a partition provided in the development device.

FIG. 5 is a plan view illustrating the partition 43.

As illustrated in FIG. 5, in the present invention, each of the openings 42 includes a rhombus shape. By forming the opening 42 in a rhombus shape, if the toners are carried in the arrow X direction in the figure, the falling toner amount is small in the beginning, and then is gradually increased in the portion Al in which the width of the opening 42 is gradually increased in the developer carrying direction X.

Figure 7:
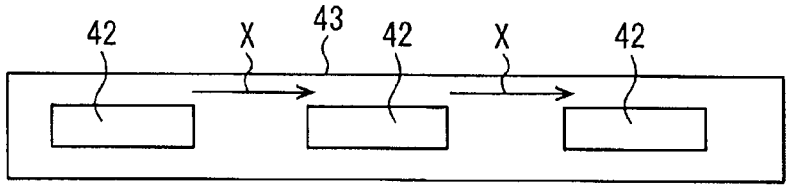
FIG. 7 is a plane view illustrating a partition according to a comparative example.

Meanwhile, when the opening 42 includes a rectangle shape as the partition 43 of the comparative example illustrated in FIG. 7, if the toners are carried in the arrow X direction in the figure, a lot of toners falls at one time when the toners reach the end portion of the opening 42. If a lot of toners are supplied in the developer tank 40 at one time, rapid mutual charging is conducted between the supplied new toners and the old toners in the developer tank 40, so that defects such as the above-described surface staining and variations in image concentration become remarkable.

On the other hand, in the present embodiment, a lot of toners are not supplied in the developer tank 40 at one time as described above, and the amount of toners to be supplied in the developer tank 40 is gradually increased in the developer carrying direction X. The rapid mutual charging can be thereby controlled between the new toners and the old toners, so that the defects such as surface staining and variations in image concentration can be reduced. In the present embodiment, with a simple configuration which forms each of the openings 42 of the partition 43 in a rhombus shape, the generation of defects such as surface staining and variations in image concentration can be reduced, and a preferable image quality can be stably obtained.

If a length L1 of the opening area A1 in the developer carrying direction in which the width of the opening 42 is gradually increased in the developer carrying direction X as illustrated in FIG. 5 is formed to be longer than a pitch S of the carrier screw 49 as illustrated in FIG. 4, the rapid mutual charging between the toners can be further effectively controlled.

Figure 6A:
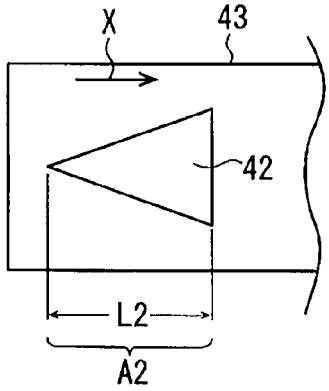
FIGS. 6A, 6B are plan views each illustrating a modified example of the partition.
Figure 6B:
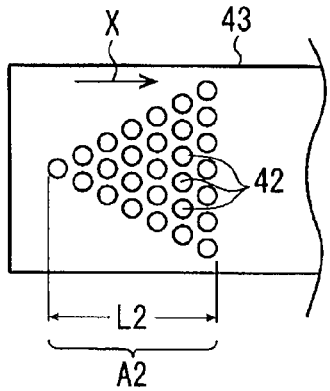

FIGS. 6A, 6B illustrate the partitions 43 according to the modified examples, respectively.

In the modified example illustrated in FIG. 6A, the opening 42 is formed in a triangular shape, and the width of the opening 42 is gradually increased in the developer carrying direction X. In the modified example illustrated in FIG. 6B, a plurality of circular openings 42 is formed, and the number of openings 42 is increased in the developer carrying direction X, and the opening area ratio of the opening 42 is gradually increased in the developer carrying direction X. In any modified example illustrated in FIGS. 6A, 6B, similar to the above embodiment, the amount of toners to be supplied in the developer tank 40 can be gradually increased in the developer carrying direction X, so that the rapid mutual charging between the toners can be controlled, and the defects such as surface staining and variations in image concentration can be reduced. In this case, by forming the shape of the opening 42 into a predetermined shape, or with a simple configuration which sets the arrangement and the number of openings 42, the rapid mutual charging between the toners can be controlled.

If a length L2 of the opening area A2 (the opening area in which the width of the opening 42 is gradually increased in the developer carrying direction X) of the opening 42 in the developer carrying direction X illustrated in FIG. 6A, or a length L2 of the opening area A2 (the opening area in which the opening area ratio of the openings 42 is gradually increased in the developer carrying direction X) of the opening 42 in the developer carrying direction X illustrated in FIG. 6B is formed to be longer than the pitch S of the carrier screw 49, similar to the above, the rapid mutual charging between the toners can be further effectively controlled.

Although the embodiment of the present invention has been described above, the present invention is not limited thereto. It should be appreciated that variations may be made in the embodiment described by persons skilled in the art without departing from the scope of the present invention. In the present embodiment, the carrier screw 49 is used as a developer carrier member disposed in the developer container 41, but a carrier coil or another carrier is applicable. However, the carrier screw can increase the carrier speed of the toners compared to the carrier coil, so that the increase in the falling amount of the toners from the openings 42 can be reduced, and the rapid mutual charging between the toners can be effectively controlled. In addition, when using the carrier coil, by forming the length L1 of the opening area A1 in the developer carrying direction X illustrated in FIG. 5 or the length L2 of the opening area A2 in the developer carrying direction X illustrated in FIGS. 6A, 6B longer than the pitch of the carrier coil, similar to the case using the carrier screw, the rapid mutual charging between the toners can be further effectively controlled.

A plurality of openings 42 is disposed in the partition 43, but one opening 42 can be provided in the partition 43. However, as in the above embodiment illustrated in FIG. 2, in a so-called vertical development device in which the toners are filled above the development roller 44 and the supply roller 45, the pressure of the toners is intensively received in the portions lower than the supply roller 45 and near the control blade 46, so that if the number of openings 42 is small, the toners are easily stacked. For this reason, by providing two openings 42 or more in the developer transport direction, a development device which has a stable performance and does not have clogging of the toners can be provided.

In the above embodiment, the crushed toner of 8.5 μm in volume average particle diameter is used, but the similar effects can be obtained if polarized toners made by a polarized method are used. Specifically, the similar effects can be obtained if the polarized toners of a polyester surface and a styrene acrylic surface of 0.98 in circularity degree and 5-6 μm in volume average particle diameter are used.

The configuration of the present invention is applicable to a development device, a processing unit, and an image forming device such as a printer, a copier, a facsimile or a machine combining these, which have a configuration different to that of the present embodiment.

According to the embodiment of the present invention, since the amount of developer to be supplied to the developer tank is gradually increased in the developer carrying direction, the rapid mutual charging between the newly supplied developer and the old developer in the developer tank can be controlled; thus, the defects such as surface staining and variations in image concentration can be reduced.

According to the embodiment of the present invention, by gradually increasing the width of the opening in the developer carrying direction, the amount of developer to be supplied in the developer tank can be gradually increased in the developer carrying direction. In this case, with a simple configuration which forms the opening in a predetermined shape, the rapid mutual charging between the developers can be controlled.

According to the embodiment of the present invention, by forming the opening in a rhombus shape, the width of the opening is gradually increased in the development carrying direction, so that the amount of developer to be supplied in the developer tank can be gradually increased in the developer carrying direction.

According to the embodiment of the present invention, by forming the length of the opening area in the developer carrying direction in which the width of the opening is gradually increased in the developer carrying direction to be longer than the pitch of the carrier coil or the carrier screw, rapid mutual charging between the developers can be further effectively controlled.

According to the embodiment of the present invention, by increasing the number of openings in the developer carrying direction, and gradually increasing the opening area ratio of the opening in the developer carrying direction, the developer amount to be supplied in the developer tank can be gradually increased in the developer carrying direction. In this case, with a simple configuration which sets the number and the arrangement of the openings, the rapid mutual charging between the developers can be controlled.

According to the embodiment of the present invention, by forming the length of the opening area in the developer carrying direction in which the opening area ratio of the opening is gradually increased in the developer carrying direction to be longer than the pitch of the carrier coil or the carrier screw, the rapid mutual charging between the developers can be further effectively controlled.

According to the embodiment of the present invention, if the carrier screw is used as the developer carrier member, the carrying speed of the developer can be increased, so that the increase in the supply amount of the developer from the opening can be reduced, and thus, the rapid mutual charging between the developers can be effectively controlled.

According to the embodiment of the present invention, by providing two or more openings in the developer carrying direction, the development device which has a stable performance and does not have the clogging of the developer can be provided.

According to the embodiment of the present invention, by providing the developer supply member and the control member in the developer tank, the agitation and the mixing of the developer in the developer tank can be effectively conducted by the flow of the developer by the developer supply member and the flow of the developer which has not passed through the control member.

According to the embodiment of the present invention, since the processing unit includes the above-described development device, the above effects by the development device can be obtained, and a processing unit which can easily maintain and exchange an image forming device can be provided.

According to the embodiment of the present invention, since the image forming apparatus includes the above-described development device, the effects by the development device can be obtained.

According to the embodiment of the present invention, since the image forming apparatus includes the above-described processing unit, the above effects by the development device provided in the processing unit can be obtained.

According to the embodiment of the present invention, since the rapid mutual charging can be controlled between the supplied new toners and the old toners in the developer tank, the defects such as surface staining and variations in image concentration can be reduced, and a preferable image quality can be stably obtained.

What is claimed is:

1. A development device, comprising:

a developer carrier configured to carry on a surface thereof a developer, the developer carrier being disposed to face a latent image carrier;

a developer tank having the developer carrier;

a developer container configured to house the developer to be supplied to the developer tank, the developer container being connected to the developer tank through a partition having an opening; and a developer carrier member configured to carry the developer in the developer container, the developer being supplied to the developer tank from the opening while being carried by the developer carrier member, the amount of developer to be supplied to the developer tank from the opening being gradually increased in a developer carrying direction of the developer carrier member, and the opening including an apex that is a leading part of the opening when moving along a length of the opening in the developer carrying direction, such that a first peripheral section of the opening that extends from the apex is positively sloped relative to the developer carrying direction, and a second peripheral section of the opening that extends from the apex is negatively sloped relative to the developer carrying direction.

2. The development device according to claim 1, wherein a width of the opening is gradually increased in the development carrying direction.

3. The development device according to claim 2, wherein the opening has a rhombus shape.

4. The development device according to claim 2, wherein the developer carrier member is a carrier coil, and a length of an opening area in the developer carrying direction in which the width of the opening is gradually increased in the developer carrying direction is formed to be longer than a pitch of the carrier coil.

5. The development device according to claim 2, wherein the developer carrier member is a carrier screw, and a length of an opening area in the developer carrying direction in which the width of the opening is gradually increased in the developer carrying direction is formed to be longer than a pitch of the carrier screw.

6. The development device according to claim 1, wherein the opening includes a number of constituent openings, the number of constituent openings is gradually increased in the developer carrying direction, and an opening area ratio of the opening is gradually increased in the developer carrying direction.

7. The development device according to claim 6, wherein the developer carrier member is a carrier coil, and a length of an opening area in the developer carrying direction in which the opening area ratio of the opening is gradually increased in the developer carrying direction is formed to be longer than a pitch of the carrier coil.

8. The development device according to claim 6, wherein the developer carrier member is a carrier screw, and a length of an opening area in the developer carrying direction in which the opening area ratio of the opening is gradually increased in the developer carrying direction is formed to be longer than a pitch of the carrier screw.

9. The development device according to claim 1, wherein the opening is provided in two or more portions in the developer carrying direction.

10. The development device according to claim 1, wherein the developer tank includes a developer supply member which supplies the developer to the developer carrier and a control member which controls the amount of developer on the developer carrier.

11. An image forming apparatus, comprising:

a developer carrier configured to carry on a surface thereof developer, the developer carrier being disposed to face a latent image carrier;

a developer tank having the developer carrier;

a developer container configured to house the developer to be supplied to the developer tank, the developer container being connected to the developer tank through a partition having an opening; and a developer carrier member configured to carry the developer in the developer container, the developer being supplied to the developer tank from the opening while being carried by the developer carrier member, the amount of developer to be supplied to the developer tank from the opening being gradually increased in a developer carrying direction of the developer carrier member, and the opening including an apex that is a leading part of the opening when moving along a length of the opening in the developer carrying direction, such that a first peripheral section of the opening that extends from the apex is positively sloped relative to the developer carrying direction, and a second peripheral section of the opening that extends from the apex is negatively sloped relative to the developer carrying direction.

12. The image forming apparatus according to claim 11, wherein a width of the opening is gradually increased in the development carrying direction.

13. The image forming apparatus according to claim 12, wherein the opening has a rhombus shape.

14. The image forming apparatus according to claim 12, wherein the developer carrier member is a carrier coil, and a length of an opening area in the developer carrying direction in which the width of the opening is gradually increased in the developer carrying direction is formed to be longer than a pitch of the carrier coil.

15. The image forming apparatus according to claim 12, wherein the developer carrier member is a carrier screw, and a length of an opening area in the developer carrying direction in which the width of the opening is gradually increased in the developer carrying direction is formed to be longer than a pitch of the carrier screw.

16. The image forming apparatus according to claim 11, wherein the opening includes a number of constituent openings, the number of constituent openings is gradually increased in the developer carrying direction, and an opening area ratio of the opening is gradually increased in the developer carrying direction.

17. The image forming apparatus according to claim 16, wherein the developer carrier member is a carrier coil, and a length of an opening area in the developer carrying direction in which the opening area ratio of the opening is gradually increased in the developer carrying direction is formed to be longer than a pitch of the carrier coil.

18. The image forming apparatus according to claim 16, wherein the developer carrier member is a carrier screw, and a length of an opening area in the developer carrying direction in which the opening area ratio of the opening is gradually increased in the developer carrying direction is formed to be longer than a pitch of the carrier screw.

19. The image forming apparatus according to claim 11, wherein the opening is provided in two or more portions in the developer carrying direction.

20. The image forming apparatus according to claim 11, wherein the developer tank includes a developer supply member which supplies the developer to the developer carrier and a control member which controls the amount of developer on the developer carrier.

* * * * *